US006065318A

United States Patent [19]

Maniwa et al.

[11] Patent Number: 6,065,318

[45] Date of Patent: May 23, 2000

[54] HOUSINGLESS ROLLING MILL

[75] Inventors: Shuji Maniwa; Keiji Mizuta; Kazuo Morimoto; Kanehisa Miyaguchi, all of Hiroshima, Japan

[73] Assignee: Mitsubishi Heavy Industries, Ltd., Tokyo, Japan

[21] Appl. No.: 09/188,186

[22] Filed: Nov. 10, 1998

[30] Foreign Application Priority Data

Nov. 11, 1997 [JP] Japan ..... 9-308284

[51] Int. Cl.[7] ..... B21B 31/00

[52] U.S. Cl. ..... 72/237; 72/248; 72/10.6; 72/14.5

[58] Field of Search ..... 72/237, 240, 245, 72/248, 10.4, 10.6, 14.4, 14.5, 8.3, 11.1

[56] References Cited

U.S. PATENT DOCUMENTS 3,309,909 3/1967 Wilson ..... 72/237
3,580,034 5/1971 Wilson ..... 72/237
4,557,130 12/1985 Bond ..... 72/237
4,570,472 2/1986 Kuwano ..... 72/235
5,870,916 2/1999 Drigani et al. ..... 72/237

*Primary Examiner*—Ed Tolan

[57] ABSTRACT

A housingless rolling mill having an upper and lower work roll, upper bearing blocks and lower bearing blocks for supporting the upper and lower work rolls, and screw-down cylinders for pulling the upper and lower bearing blocks vertically toward each other. The screw-down cylinder is tiltable with the use of upper and lower spherical. Legs of the lower bearing block are turnable in a roll cross direction. Lower cross cylinders are provided at the lower bearing block, and upper cross cylinders are provided at the upper bearing block to enable the work rolls to cross at an angle θ. Thus, a strip material is rolled to a satisfactory shape and thickness with the upper work roll and the lower work roll crossing each other.

20 Claims, 12 Drawing Sheets

21c : Entry/Work Side Cylinder Position Detector
21d : Delivery/Work Side Cylinder Positision Detector
22c : Entry/Work Side Servo Valve
22d : Delivery/Work Side Servo Valve
23c : Entry/Work Side Pressure Detector
23d : Delivery/Work Side Pressure Detector
25 : Zigzag Movement Detector
30 : Digital Controller 21a : Entry/Drive Side Cylinder Position Detector
21b : Delivery/Drive Side Cylinder Positision Detector
22a : Entry/Drive Side Servo Valve
22b : Delivery/Drive Side Servo Valve
23a : Entry/Drive Side Pressure Detector
23b : Delivery/Drive Side Pressure Detector

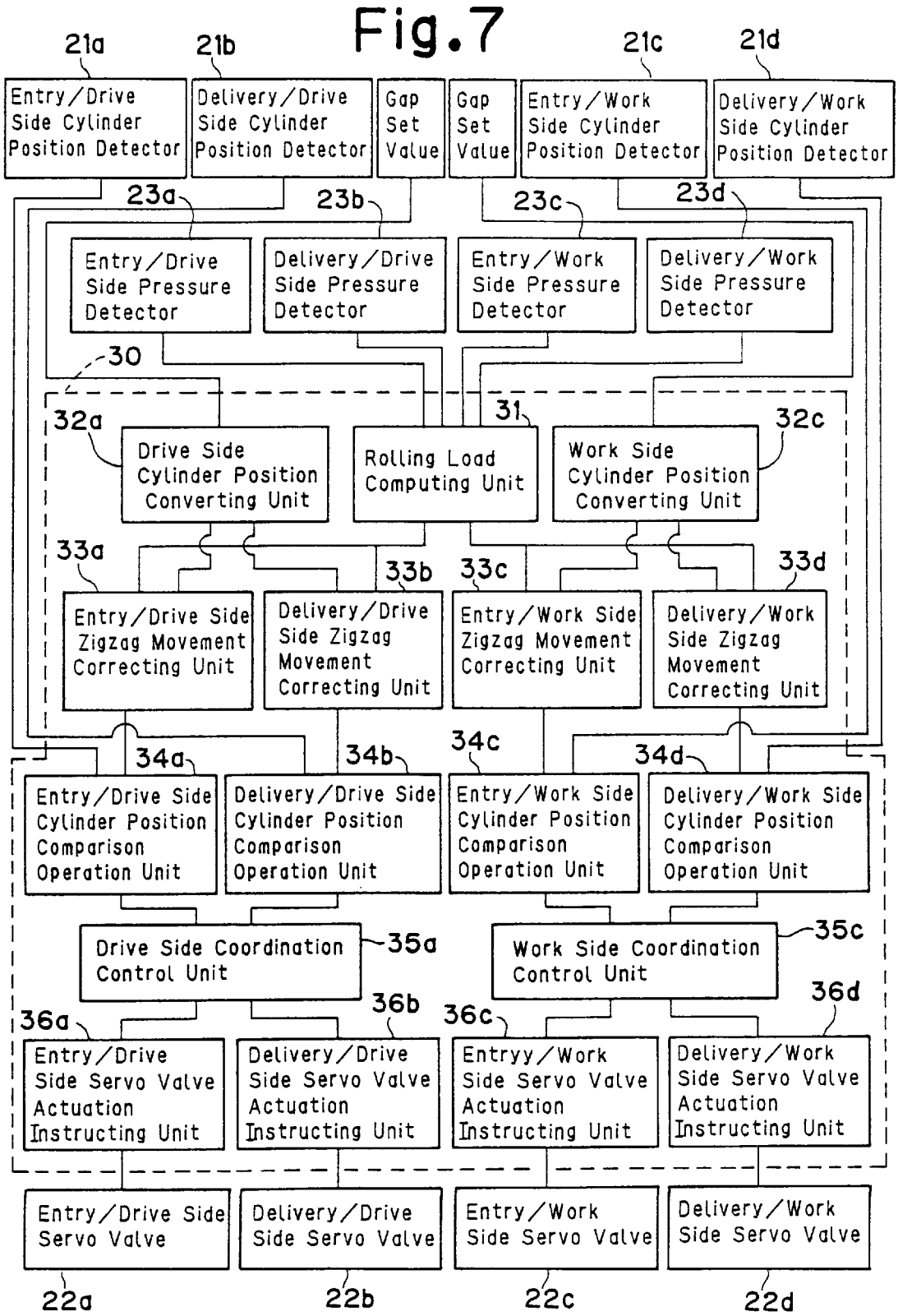
Fig.7
21a
21b
21c
21d
Entry/Drive Side Cylinder Position Detector
Delivery/Drive Side Cylinder Position Detector
Gap Set Value
Gap Set Value
Entry/Work Side Cylinder Position Detector
Delivery/Work Side Cylinder Position Detector
23a
23b
23c
23d
Entry/Drive Side Pressure Detector
Delivery/Drive Side Pressure Detector
Entry/Work Side Pressure Detector
Delivery/Work Side Pressure Detector
30
32a
31
32c
Drive Side Cylinder Position Converting Unit
Rolling Load Computing Unit
Work Side Cylinder Position Converting Unit
33a
33b
33c
33d
Entry/Drive Side Zigzag Movement Correcting Unit
Delivery/Drive Side Zigzag Movement Correcting Unit
Entry/Work Side Zigzag Movement Correcting Unit
Delivery/Work Side Zigzag Movement Correcting Unit
34a
34b
34c
34d
Entry/Drive Side Cylinder Position Comparison Operation Unit
Delivery/Drive Side Cylinder Position Comparison Operation Unit
Entry/Work Side Cylinder Position Comparison Operation Unit
Delivery/Work Side Cylinder Position Comparison Operation Unit
Drive Side Coordination Control Unit
35a
Work Side Coordination Control Unit
35c
36a
36b
36c
36d
Entry/Drive Side Servo Valve Actuation Instructing Unit
Delivery/Drive Side Servo Valve Actuation Instructing Unit
Entryy/Work Side Servo Valve Actuation Instructing Unit
Delivery/Work Side Servo Valve Actuation Instructing Unit
Entry/Drive Side Servo Valve
Delivery/Drive Side Servo Valve
Entry/Work Side Servo Valve
Delivery/Work Side Servo Valve
22a
22b
22c
22d 21c : Entry/Work Side Cylinder Position Detector
21d : Delivery/Work Side Cylinder Positision Detector
22c : Entry/Work Side Servo Valve
22d : Delivery/Work Side Servo Valve
25 : Zigzag Movement Detector
40 : Digital Controller 21a : Entry/Drive Side Cylinder Position Detector
21b : Delivery/Drive Side Cylinder Positision Detector
22a : Entry/Drive Side Servo Valve
22b : Delivery/Drive Side Servo Valve

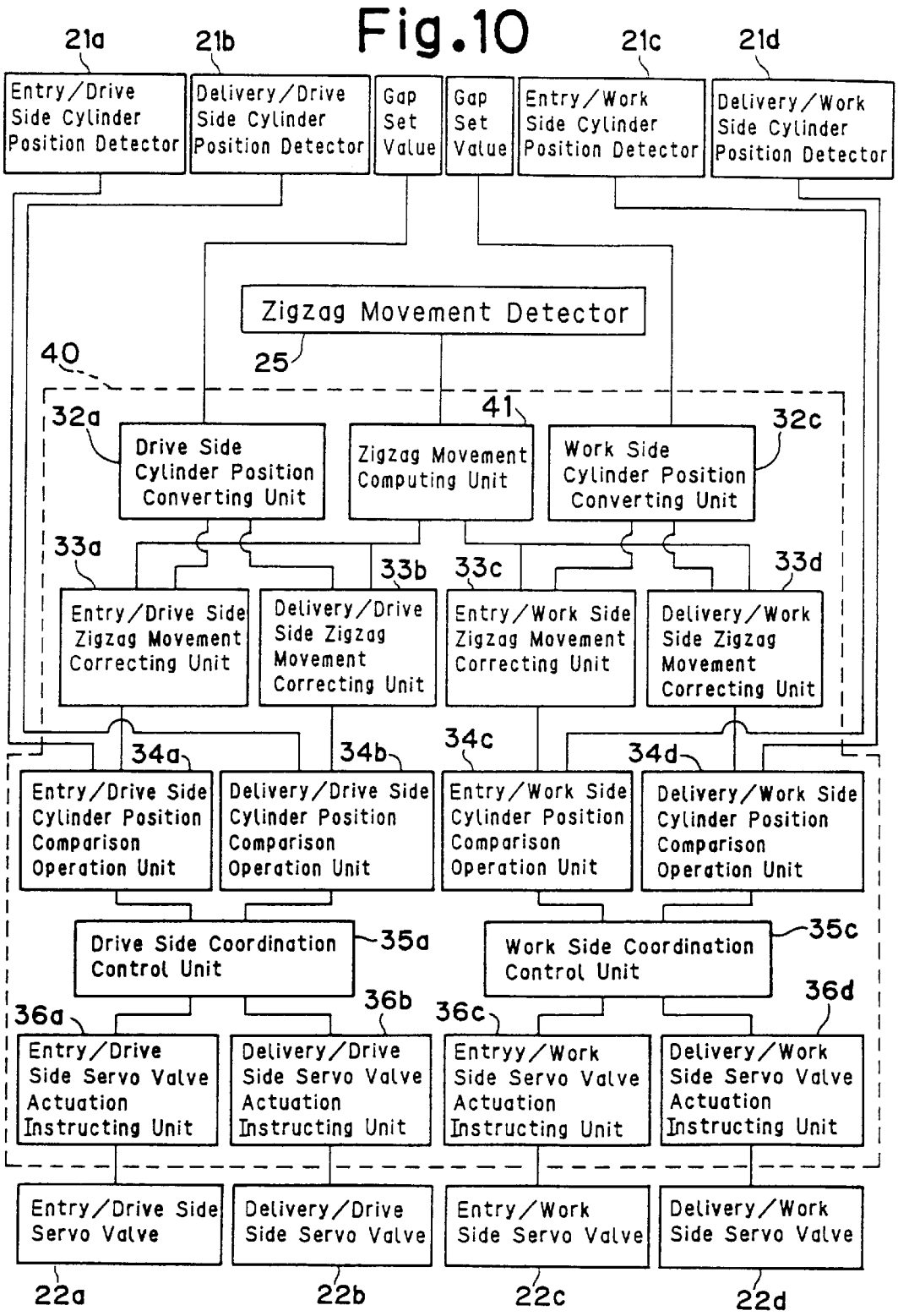
Fig.10
21a
21b
21c
21d
Entry/Drive Side Cylinder Position Detector
Delivery/Drive Side Cylinder Position Detector
Gap Set Value
Gap Set Value
Entry/Work Side Cylinder Position Detector
Delivery/Work Side Cylinder Position Detector
Zigzag Movement Detector
25
40
41
32a
32c
Drive Side Cylinder Position Converting Unit
Zigzag Movement Computing Unit
Work Side Cylinder Position Converting Unit
33a
33b
33c
33d
Entry/Drive Side Zigzag Movement Correcting Unit
Delivery/Drive Side Zigzag Movement Correcting Unit
Entry/Work Side Zigzag Movement Correcting Unit
Delivery/Work Side Zigzag Movement Correcting Unit
34a
34b
34c
34d
Entry/Drive Side Cylinder Position Comparison Operation Unit
Delivery/Drive Side Cylinder Position Comparison Operation Unit
Entry/Work Side Cylinder Position Comparison Operation Unit
Delivery/Work Side Cylinder Position Comparison Operation Unit
Drive Side Coordination Control Unit
35a
Work Side Coordination Control Unit
35c
36a
36b
36c
36d
Entry/Drive Side Servo Valve Actuation Instructing Unit
Delivery/Drive Side Servo Valve Actuation Instructing Unit
Entryy/Work Side Servo Valve Actuation Instructing Unit
Delivery/Work Side Servo Valve Actuation Instructing Unit
Entry/Drive Side Servo Valve
Delivery/Drive Side Servo Valve
Entry/Work Side Servo Valve
Delivery/Work Side Servo Valve
22a
22b
22c
22d

HOUSINGLESS ROLLING MILL

BACKGROUND OF THE INVENTION

1. Field of the Invention

The present invention relates to a rolling mill for rolling a steel strip or a steel bar. More specifically, the invention relates to a rolling mill in which both ends of upper and lower work rolls are supported by upper and lower bearing blocks, respectively, and these upper and lower work rolls are pulled to each other vertically to screw down the upper work roll, thus obviating the need for housings.

2. Description of the Related Art

Among conventional rolling mills, there is a rolling mill as shown in FIGS. 11 and 12. In these drawings, the reference numeral 51 designates an upper work roll, and 52 a lower work roll. These work rolls are rotatably mounted, by their shafts, to upper roll chocks 53 and lower roll chocks 54, and are mounted internally above and below a pass line of housings 61. The reference numeral 55 designates a screw, and 56 a screw-down cylinder for finely adjusting the height of the upper work roll 51. The reference numeral 57 designates an upper cross cylinder, and 58 a lower cross cylinder. To the front ends of rod portions of these cross cylinders, crossheads 59, 60 are mounted for engagement with the upper roll chock 53 and the lower roll chock 54.

In the housing 61 on a work side, upper thrust point blocks 62 and lower thrust point blocks 72 are mounted. Into the upper roll chock 53, as shown in FIG. 11, a four-link type thrust point device is inserted by use of the upper thrust point blocks 62. The thrust point device is composed of rollers 63 fitted into notched portions 62*a* of the thrust point blocks 62, shafts 65 supporting the rollers 63 and levers 64, the shafts 65 and the levers 64 being pivotably attached to the upper roll chock 53, and a link 66 connecting both levers 64 together. Into the lower roll chock 54, too, a similar four-link type thrust point device is inserted by use of the lower thrust point blocks 72.

The screw 55 is turned to adjust the heights of the upper roll chock 53 and the upper work roll 51, and set the roll gap between the upper work roll 51 and the lower work roll 52 necessary for the rolling of a strip material 50. The upper and lower cross cylinders 57, 58 are actuated to turn the upper work roll 51 and the lower work roll 52 in the opposite directions about a cross point, $C_P$, causing them to cross at a required cross angle, θ. The upper work roll 51 and the lower work roll 52 are rotationally driven by a drive device (not shown) to bring the strip material 50, which has been conveyed, into engagement with them. The height of the upper work roll 51 is finely adjusted by the screw-down cylinder 56. Also, the cross angle θ is finely adjusted by the upper and lower cross cylinders 57, 58. Under these actions, the strip material 50 is rolled with its thickness and shape being kept satisfactory, to have a desired thickness.

The foregoing conventional rolling mill needs the heady housings 61 incorporating the upper and lower roll chocks 53, 54, a screw-down device of a complicated structure having the screw 55 and the screw-down cylinder 56, and the four-link type thrust point device of a complicated structure. Thus, the manufacturing cost and the maintenance cost for the rolling mill are high, and a wide installation space is required. Furthermore, the width of the housing in the direction of rolling is so large that rolling mills of this type, if arranged tandem in a row, create a long line.

SUMMARY OF THE INVENTION

The object of the present invention is to provide a rolling mill which requires no housing, which is lower in weight, manufacturing cost, requires less installation space, and which can easily control the thickness and a zigzag movement of a material to be rolled.

A housingless rolling mill according to the present invention attains the above-mentioned object by the following constitutions:

(1) A housingless rolling mill comprising an upper work roll and a lower work roll, upper bearing blocks and lower bearing blocks for supporting both end portions of the upper and lower work rolls, and roll screw-down devices provided so as to pull the upper bearing blocks and the lower bearing blocks to each other vertically on an entry side and a delivery side.

(2) The rolling mill of (1), wherein protrusions are formed at an entry side and a delivery side of each of the upper bearing block and the lower bearing block, an upper spherical hole and a lower spherical hole are bored in the protrusions of the upper and lower bearing blocks such that these holes define spherical portions opposed to each other vertically, an upper spherical bush and a lower spherical bush sliding over the upper and lower spherical portions, respectively, are provided at an upper site and a lower site of the roll screw-down device to make the roll screw-down device tiltable, legs of the lower bearing block are supported so as to be turnable in a roll cross direction, lower roll cross devices are provided at the lower bearing block, and upper roll cross devices are provided at the upper bearing block.

(3) The rolling mill of (2), wherein a supported member is provided in at least one of the upper bearing block and the lower bearing block lying in a thrust direction of at least one of the upper work roll and the lower work roll, a thrust point member which engages the supported member is provided in at least the other of the upper bearing block and the lower bearing block lying in the direction opposite to the thrust direction, and a surface of the thrust point member which supports the supported member is formed to have an arcuate curved surface of a radius originating from a work roll cross point ($C_P$) as a center.

(4) The rolling mill of (1), further comprising an entry/drive side screw-down amount detector, a delivery/drive side screw-down amount detector, an entry/work side screw-down amount detector, and a delivery/work side screw-down amount detector provided in screw-down cylinders of the roll screw-down devices at an entry side and a delivery side of the upper bearing blocks and the lower bearing blocks on a drive side and a work side, an entry/drive side pressure detector, a delivery/drive side pressure detector, an entry/work side pressure detector, and a delivery/work side pressure detector provided so as to detect the load pressures of the respective screw-down cylinders, and a roll gap control device for receiving detection signals from the respective screw-down amount detectors and pressure detectors and actuating the roll screw-down devices on the drive side and the work side of the upper and lower work rolls.

(5) The rolling mill of (1), further comprising an entry/drive side screw-down amount detector, a delivery/drive side screw-down amount detector, an entry/work side screw-down amount detector, and a delivery/work side screw-down amount detector provided in screw-down cylinders of the roll screw-down devices at an entry side and a delivery side of the upper bearing blocks and lower bearing blocks on a drive side and a work side, a zigzag movement detector provided on the entry side of the upper and lower work rolls, and a roll gap control device for receiving detection signals from the respective screw-down amount detectors and the zigzag movement detector and actuating the roll screw-down devices on the drive side and the work side of the upper and lower work rolls.

(1) The roll screw-down devices move the upper bearing blocks upward and downward to set a roll gap between the upper work roll and the lower work roll. These upper and lower work rolls are rotationally driven, and a material to be rolled, which is being transported, is engaged into this roll gap, whereby it is rolled to a required thickness. During rolling of the material, the roll screw-down devices are finely operated according to changes in the thickness of the material to adjust the roll gap finely, thereby keeping the material at a required thickness.

(2) In addition to the action (1), a combination of the upper bearing blocks and the upper work roll, and a combination of the lower bearing blocks and the lower work roll are turned in directions opposite to each other about the work roll cross point at a center, by the upper roll cross devices and the lower roll cross devices. This enables the upper work roll and the lower work roll to cross at a required cross angle. In this condition, the upper work roll and the lower work roll are rotationally driven, and the transported material to be rolled is engaged into the roll gap, and thereby rolled to a required thickness.

If the thickness distribution, in the width direction, of the material its varies during its rolling, the upper roll cross devices and the lower roll cross devices are fine operated to adjust the cross angle, thereby maintaining a satisfactory shape of the material. Crossing of the upper work roll and the lower work roll tilts the roll screw-down devices, narrowing the roll gap slightly. Thus, the roll screw-down devices are actuated according to the operating stroke lengths of the respective roll cross devices to correct the roll gap.

(3) In addition to the action of (2), when the material is rolled with the upper work roll and the lower work roll being crossed, an upper thrust force and a lower thrust force develop in the upper and lower work rolls, respectively, in the opposite roll shaft directions in accordance with the cross angle. This upper thrust force is supported by at least one of the thrust point member in the anti-thrust direction of the lower bearing block and the supported member in the thrust direction of the lower bearing block via at least one of the supported member in the thrust direction of the upper bearing block and the thrust point member in the anti-thrust direction of the upper bearing block. On the other hand, the lower thrust force is supported by at least one of the supported member in the thrust direction of the upper bearing block and the thrust point member in the anti-thrust direction of the upper bearing block via at least one of the supported member in the thrust direction of the lower bearing block and the thrust point member in the anti-thrust direction of the lower bearing block.

As a result, the upper thrust force and the lower thrust force are counteracted by each other, so that the upper and lower work rolls do not move in the roll shaft direction. During fluctuation of the cross angle, the upper bearing blocks and the lower bearing blocks turn along the arcuate curved surfaces of the thrust point members about the work roll cross point as a center.

(4) In addition to the action of (1), gap set values of the upper and lower work rolls are entered into the roll gap control device beforehand, and converted thereby into screw-down amounts of the entry side and delivery side screw-down cylinders on the drive side and the work side.

The respective roll screw-down devices are actuated, with the screw-down amounts of the respective screw-down cylinders being detected by the entry/drive side screw-down amount detector, the delivery/drive side screw-down amount detector, the entry/work side screw-down amount detector, and the delivery/work side screw-down amount detector, to adjust the screw-down amounts. By this measure, the roll gaps between the upper and lower work rolls on the drive side and the work side are set, and the upper and lower work rolls are rotationally driven. The transported material to be rolled is engaged into the roll gaps, and thereby rolled to a required thickness.

During rolling of the material, the screw-down amounts of the respective screw-down cylinders are detected by the respective screw-down detectors. Also, the load pressures of the respective cylinders are detected by the entry/drive side pressure detector, the delivery/drive side pressure detector, the entry/work side pressure detector, and the delivery/work side pressure detector. These parameters are transmitted to the roll gap control device to calculate the rolling load amounts on the entry/drive side, the delivery/drive side, the entry/work side, and the delivery/work side.

Zigzag movement correction calculated from imbalances in the rolling load between the drive side and the work side, the respective screw-down amounts set beforehand, and the screw-down amounts detected by the respective screw-down position detectors are subjected to a comparison operation. Based on the results, the respective roll screw-down devices are operated, with the respective entry-side screw-down cylinders and delivery-side screw-down cylinders being coordinated, to adjust their screw-down amounts, thereby controlling the thickness and zigzag movement of the rolled material.

(5) In addition to the action of (1), gap set values of the upper and lower work rolls are entered into the roll gap control device beforehand, and converted thereby into screw-down amounts of the respective screw-down cylinders. The respective roll screw-down devices are operated, with the screw-down amounts of the respective screw-down cylinders being detected by the respective screw-down amount detectors, to adjust their screw-down amounts. By this measure, the roll gaps between the upper and lower work rolls on the drive side and the work side are set, and the upper and lower work rolls are rotationally driven to roll the material to a required thickness.

During rolling of the material, the amount of entry-side zigzag movement of the strip material is detected by the zigzag movement detector. This amount is transmitted to the roll gap control device to calculate the respective zigzag movement correction amounts. The respective zigzag movement correction amounts, the respective screw-down amounts set beforehand, and the screw-down amounts detected by the respective screw-down amount detectors are subjected to comparison operation. Based on the results, the respective roll screw-down devices are operated, with the respective entry-side screw-down cylinders and delivery-side screw-down cylinders being coordinated, to adjust their screw-down amounts, thereby controlling the thickness and zigzag movement of the rolled material.

BRIEF DESCRIPTION OF THE DRAWINGS

FIG. 7 is a block diagram of the various control instruments of the rolling mill shown in FIGS. 5 and 6;

FIG. 10 is a block diagram of the various control instruments of the rolling mill shown in FIGS. 8 and 9;

PREFERRED EMBODIMENTS OF THE INVENTION

A housingless rolling mill according to the present invention will now be described in detail by way of embodiments with reference to the accompanying drawings.

Figure 1:
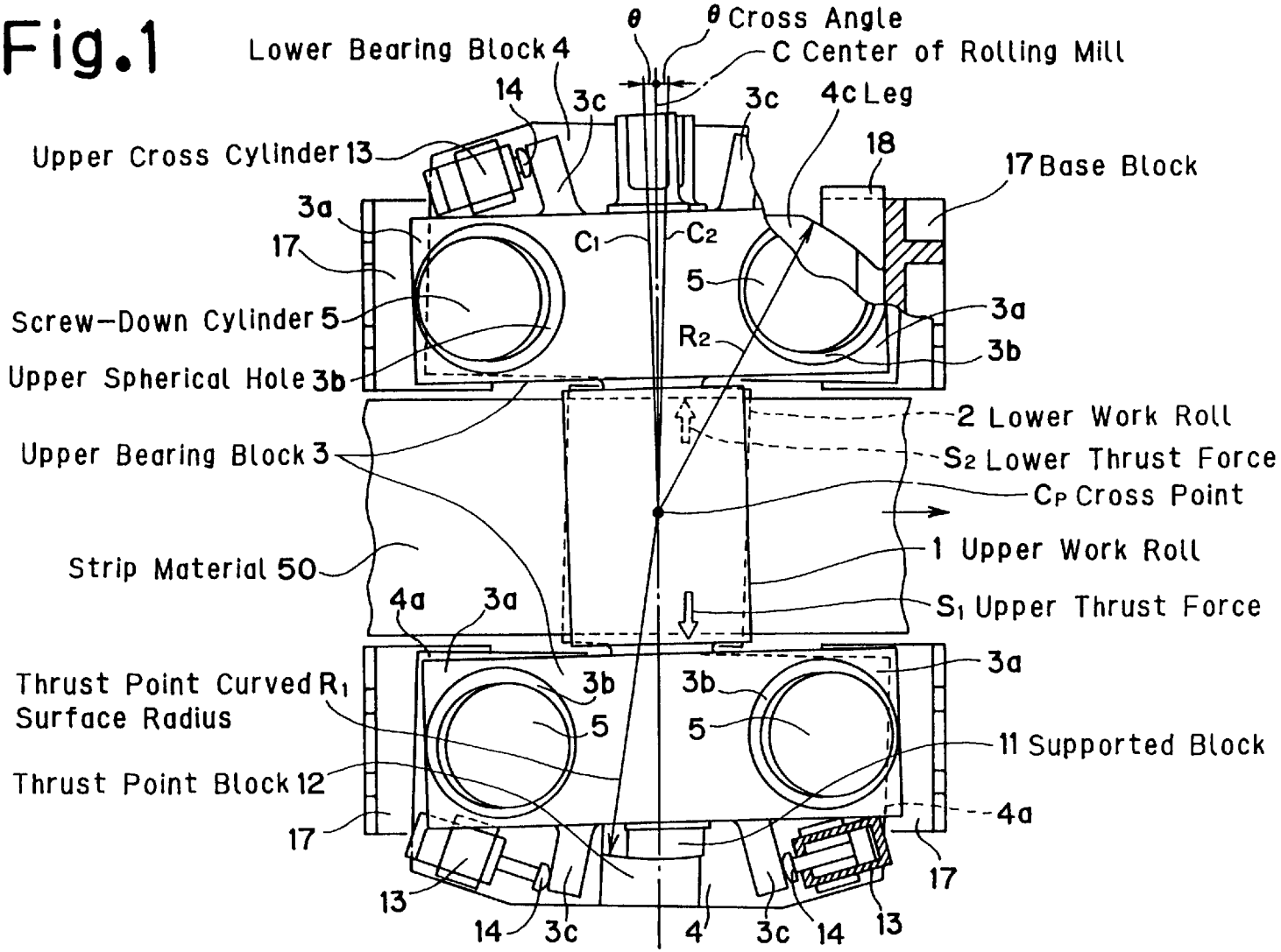
FIG. 1 is a plan view, partly broken away, of a housingless work roll cross rolling mill as a first embodiment of the present invention.
Figure 2:
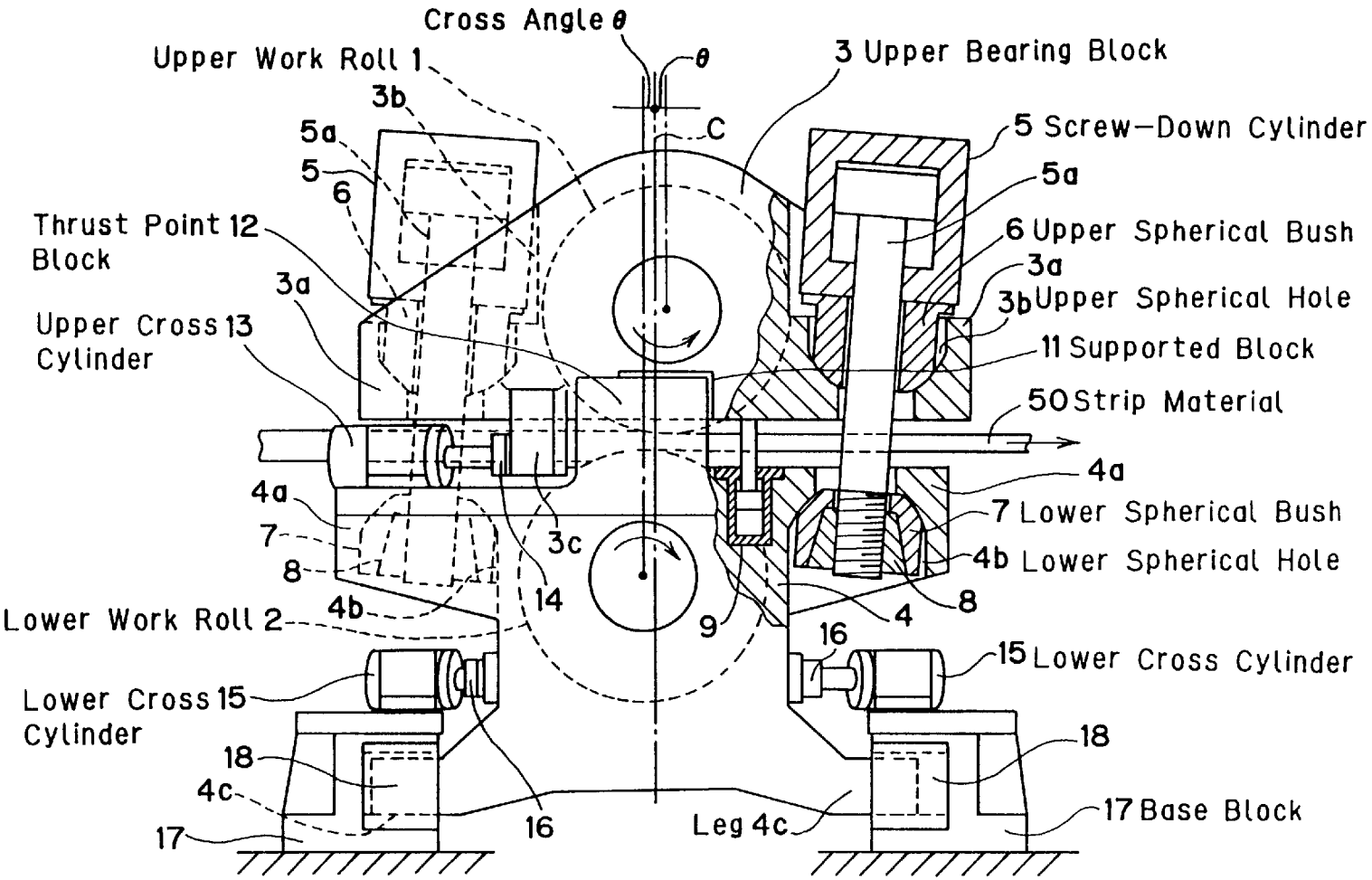
FIG. 2 is a side view, partly broken away, of the rolling mill of FIG. 1.

FIG. 1 is a plan view, partly broken away, of a housingless work roll cross rolling mill as a first embodiment of the present invention. FIG. 2 is a side view, partly broken away, of the rolling mill of FIG. 1. As illustrated, a work side end portion and a drive side end portion of each of an upper work roll 1 and a lower work roll 2 are supported by upper bearing blocks 3 and lower bearing blocks 4, respectively.

Legs 4*c* at an entry side and a delivery side of the lower bearing block 4 are supported by base blocks 17 seated and fixed on the floor such that the legs 4*c* slide arcuately about a cross point $C_P$ as a center. A work-side end portion and a drive-side end portion of the leg 4*c* are each in the form an arc with a radius $R_2$ based on the cross point $C_P$ as a center. A stopper 18 over which this arcuate portion slides is mounted to the base block 17. The upper bearing block 3 is supported by two pullback cylinders 9 which are embedded in the upper surface of the lower bearing block 4 on each of the work side and the drive side.

Protrusions 3*a*, 4*a* are formed at the entry side and the delivery side of the upper bearing block 3 and the lower bearing block 4, respectively. An upper spherical hole 3*b* and a lower spherical hole 4*b* are bored in the protrusions 3*a*, 4*a* such that these holes define spherical portions opposed to each other vertically. In the upper spherical hole 3*b* and the lower spherical hole 4*b*, a screw-down cylinder 5 is mounted such that the spherical surface of an upper spherical bush 6 slides over the spherical surface of the upper spherical hole 3*b* to tilt the screw-down cylinder 5. To a lower end portion of a rod 5*a* of the screw-down cylinder 5, a taper nut 8 and a lower spherical bush 7 sliding over a spherical surface of the lower spherical hole 4*b* are mounted.

On the respective base blocks 17, lower cross cylinders 15 are mounted, and their crossheads 16 are engaged with the entry side and the delivery side of the lower bearing block 4. On the upper surface at the entry side and the delivery side of the lower bearing block 4, upper cross cylinders 13 each having a stroke twice that of the lower cross cylinder 15 are mounted. Crossheads 14 of the upper cross cylinders 13 are engaged with protrusions 3*c* at the entry side and the delivery side of the upper bearing block 3.

At an upper part of the lower bearing block 4 on the work side, a thrust point block 12 is mounted. A slide surface thereof for sliding support of a supported block 11 of the upper bearing block 3 is formed in an arcuate form having a thrust point curved surface radius $R_1$ based on the cross point $C_P$ as a center. In place of the supported block 11, the same roller as in the conventional device may be used. The thrust point block 12 may also be mounted on the upper bearing block 3 on the drive side, and the supported block 11 may also be mounted on the lower bearing block 4.

A roll gap between the upper work roll 1 and the lower work roll 2 is set by the respective pullback cylinders 9 and screw-down cylinders 5. Also, a combination of the lower bearing blocks 4 and the lower work roll 2 and a combination of the upper bearing blocks 3 and the upper work roll 1 are turned in directions opposite to each other about the cross point $C_P$ by the respective lower cross cylinders 15 and upper cross cylinders 13 to make the upper and lower work rolls 1, 2 cross at a required cross angle θ. The upper and lower work rolls 1, 2 are rotationally driven by a drive device, a spindle and a universal joint (not shown). A strip material 50 to be rolled, which is being transported, is engaged into the roll gap between the upper and lower work rolls 1 and 2, whereby it is rolled to a required thickness.

If the thickness of the strip material 50 changes during its rolling, the respective roll screw-down cylinders 5 are actuated to finely adjust the thickness of the strip material. If the thickness distribution of the strip material in its width direction changes, the respective lower cross cylinders 15 are operated, and the upper cross cylinders 13 are also operated with a stroke length twice that of the lower cross cylinder 15 to adjust the cross angle θ finely, thereby keeping the shape of the strip material 50 satisfactory.

When the upper work roll 1 and the lower work roll 2 cross, moreover, the screw-down cylinders 5 are tilted to narrow the roll gap slightly. Thus, the screw-down cylinders 5 are operated according to the operating stroke lengths of the respective cross cylinders 13, 15 to correct the roll gap.

When the strip material 50 rolled by the upper work roll 1 and the lower work roll 2 cross each other, an upper thrust force $S_1$ directed toward the work side occurs in the upper work roll 1, while a lower thrust force $S_2$ directed toward the drive side occurs in the lower work roll 2, according to their cross angle, as shown in FIG. 1.

The upper work roll 1 on which this upper thrust force $S_1$ acts, and the supported block 11 of the upper bearing block 3 are supported by the thrust point block 12 of the lower bearing block 4. Conversely the lower work roll 2 on which this lower thrust force $S_2$ acts, and the thrust point block 12 of the lower bearing block 4 are supported by the supported block 11 of the upper bearing block 3. Thus, the upper thrust force $S_1$ and the lower thrust force $S_2$ counteract by each other, so that the upper work roll 1 and the lower work roll 2 do not move in the roll shaft direction. During fluctuation of the cross angle θ, the arcuate curved surfaces of the supported block 11 and the thrust point block 12 slide on each other.

The lower bearing block 4 is positioned in the roll shaft direction by the stoppers 18 of the respective base blocks 17. During fluctuation of the cross angle θ, the arcuate curved surfaces of the legs 4*c* and the stoppers 18 slide on each other. When a difference arises between the upper thrust force $S_1$ and the lower thrust force $S_2$, the lower bearing block 4 tends to move toward the work side or the drive side.

In this case, the stoppers 18 on the work side or the drive side support this lower bearing block 4.

According to the present embodiment, the upper and lower bearing blocks 3, 4 alone are sufficient to support the upper and lower work rolls 1, 2. Thus, heavy housings are not needed, and the structure of the rolling mill can be simplified. Hence, the rolling mill can be downsized, its manufacturing cost and maintenance cost can be reduced, and its installation space can be decreased. When a plurality of the rolling mills are arranged tandem in a row, their line can be shortened.

Additionally, the cross mechanisms such as the upper and lower cross cylinders 13, 15 enable the upper work roll 1 and the lower work roll 2 to cross each other during rolling of the strip material 50. Thus, the thickness distribution of the strip material 50 in its width direction can be kept satisfactory.

Further, the supported block 11 and the thrust point block 12 engaging each other counteract the upper thrust force $S_1$ and the lower thrust force $S_2$ occurring when the upper work roll 1 and the lower work roll 2 are made to cross each other, thereby simplifying, the thrust point device. In addition, the thrust force support surfaces of the thrust point members, such as thrust point block 12 and stopper 18, are formed of an arcuate curved surface with a radius about the work roll cross point $C_P$ as a center. As a result, the upper work roll 1 and the lower work roll 2 are made to cross smoothly, and the upper thrust force $S_1$ and the lower thrust force $S_2$ can be supported relative to each other.

Figure 3:
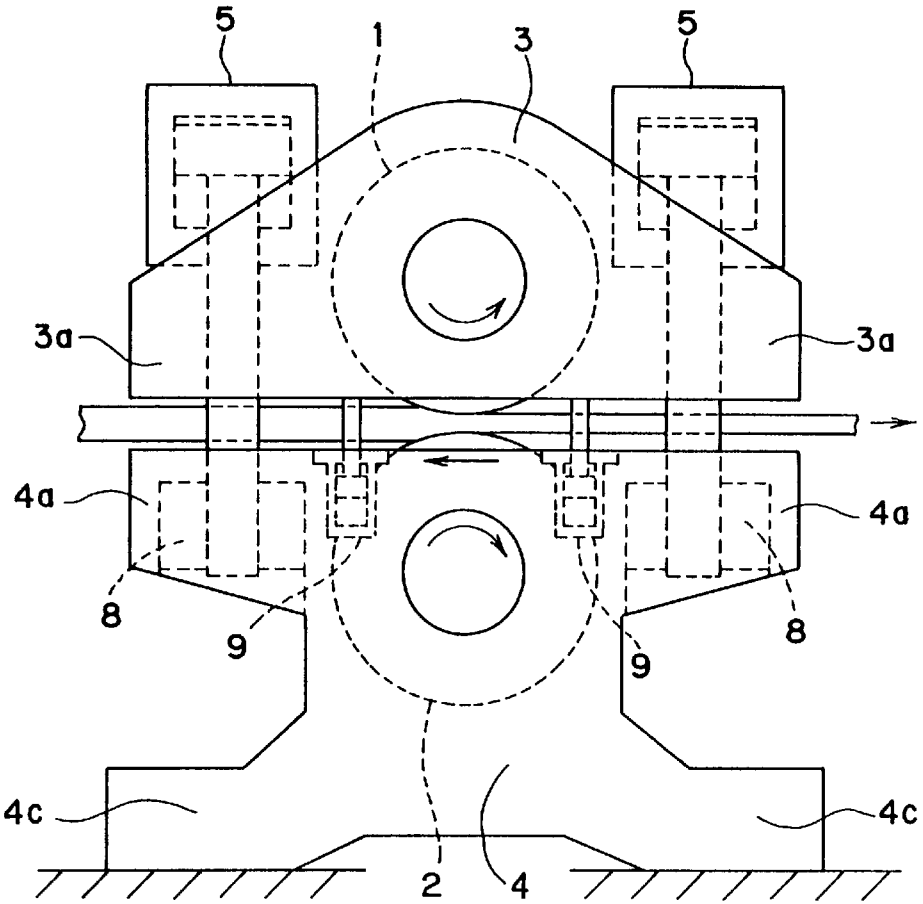
FIG. 3 is a side view of a housingless rolling mill as a second embodiment of the present invention.

FIG. 3 is a side view of a housingless rolling mill as a second embodiment of the present invention. This is an example in which the housingless rolling mill of the present invention is applied as a rolling mill which needs no crossing of work rolls.

As shown in FIG. 3, the structure of this rolling mill is such that legs 4*c* of lower bearing blocks 4 are fixed on the floor directly, without providing a cross mechanism comprising upper and lower cross cylinders 13, 15, lower spherical bushes 6, 7, a supported block 11, a thrust point block 12, base blocks 17 and stoppers 18 as in the first embodiment. The other constitutions are the same as in FIGS. 1 and 2.

According to this embodiment, respective pullback cylinders 9 and screw-down cylinders 5 move the upper bearing block 3 upward and downward to set a roll gap between the upper work roll 1 and the lower work roll 2. The upper and lower work rolls 1 and 2 are rotationally driven, and a transported strip material 50 is engaged into this roll gap, whereby it is rolled to a required thickness. During rolling of the strip material 50, the screw-down cylinders 5 are finely operated according to changes in the thickness of the strip material to adjust the roll gap finely, thereby keeping the strip material at a required thickness.

In this embodiment, like the first embodiment, heavy housings are not needed, and the structure of the rolling mill can be simplified. Hence, the rolling mill can be downsized, its manufacturing cost and maintenance cost can be reduced, and its installation space can be decreased. When a plurality of the rolling mills are arranged tandem in a row, their line can be shortened.

Figure 4:
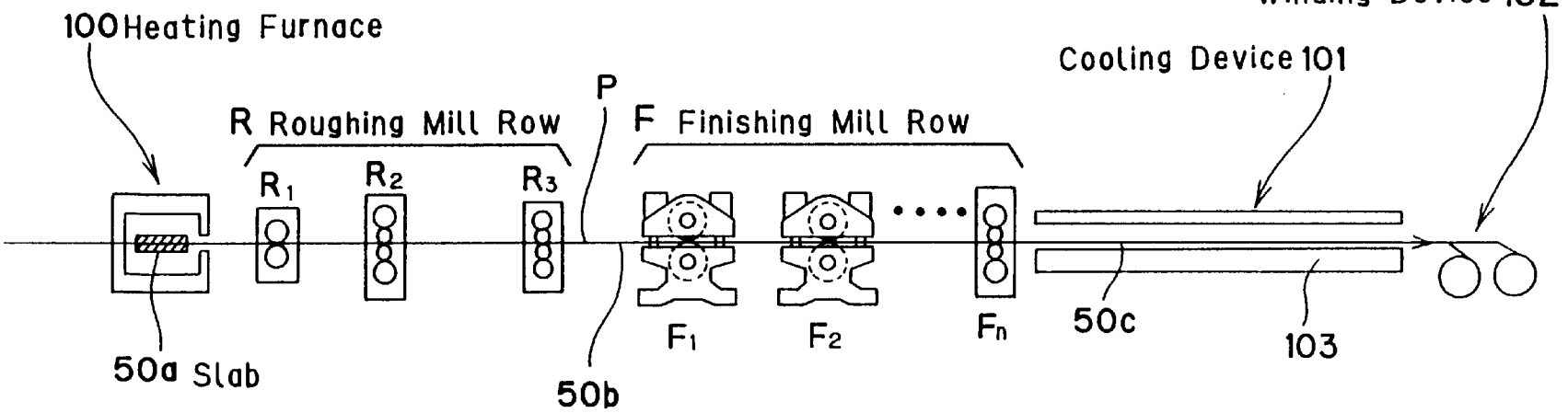
FIG. 4 is a schematic constitution drawing of hot rolling equipment as a third embodiment of the present invention.

FIG. 4 is a schematic drawing of hot rolling equipment as a third embodiment of the present invention. This is an example in which the housingless rolling mill of the present invention is applied as a finishing mill of hot rolling equipment.

As shown in FIG. 4, a slab 50*a* cast by a casting machine (not shown) is heated and kept warm in a heating furnace 100. In series with a delivery-side line of the heating furnace 100, a reversing roughing mill row R is provided. In series with a delivery-side line of the roughing mill row R, a finishing mill row F is provided. In series with the finishing mill row F, a cooling device 101 is provided. A strip 50*c* finish rolled by the finishing mill row F is cooled, and then taken up in a coil form by a winding device 102. In the drawing, the reference numeral 103 designates a hot run table, and the symbol P signifies a pass line.

The finishing mill row F is composed of two-high rolling mills $F_1$, $F_2$, . . . $F_n$ arranged tandem in a row as a plurality of stands. The housingless rolling mill in the aforementioned first embodiment (or second embodiment) is used in part, such as a preceding stand, of the two-high rolling mills $F_1$, $F_2$, . . . $F_n$.

According to this embodiment, the slab 50*a* discharged, with a thickness of, say, 250 mm and a width of, say, 1,800 mm, from the casting machine is cut to a predetermined length by a cutting machine (not shown), and then heated and kept warm in the heating furnace 100. The slab 50*a* leaving the heating furnace 100 is formed into, say, a 30 mm sheet bar 50*b* by reverse rolling with 3-stand roughing mills $R_1$, $R_2$, $R_3$ of the roughing mill row R, and sent to the finishing mill row F. In the finishing mill row F, the sheet bar 50*b* is formed into, say, a 1.2 mm strip 50*b* by tandem rolling with the plural-stand two-high rolling mills $F_1$, $F_2$, . . . $F_n$, passed between the cooling device 101 and the hot run table 103, and taken up by the winding device 102.

The above use of a small housingless rolling mill in part of the plural-stand two-high rolling mills $F_1$, $F_2$, . . . $F_n$ of the finishing mill row F shortens spacing between the rolling mills. Thus, cooling and oxidation-associated scale of the strip 50*b* or the like can be prevented.

Figure 5:
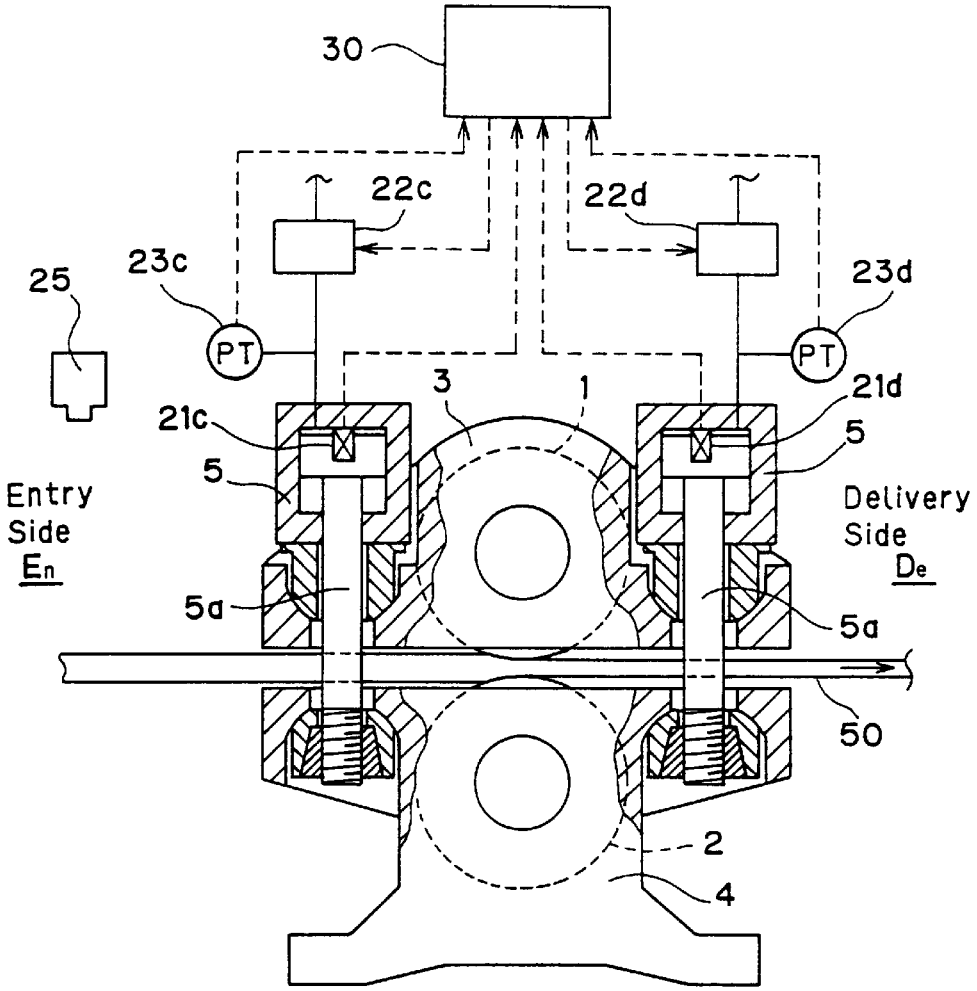
FIG. 5 is a side view of a housingless work roll cross rolling mill as a fourth embodiment of the present invention, with a roll cross mechanism and a thrust point mechanism being omitted, and various control instruments being mounted.
Figure 6:
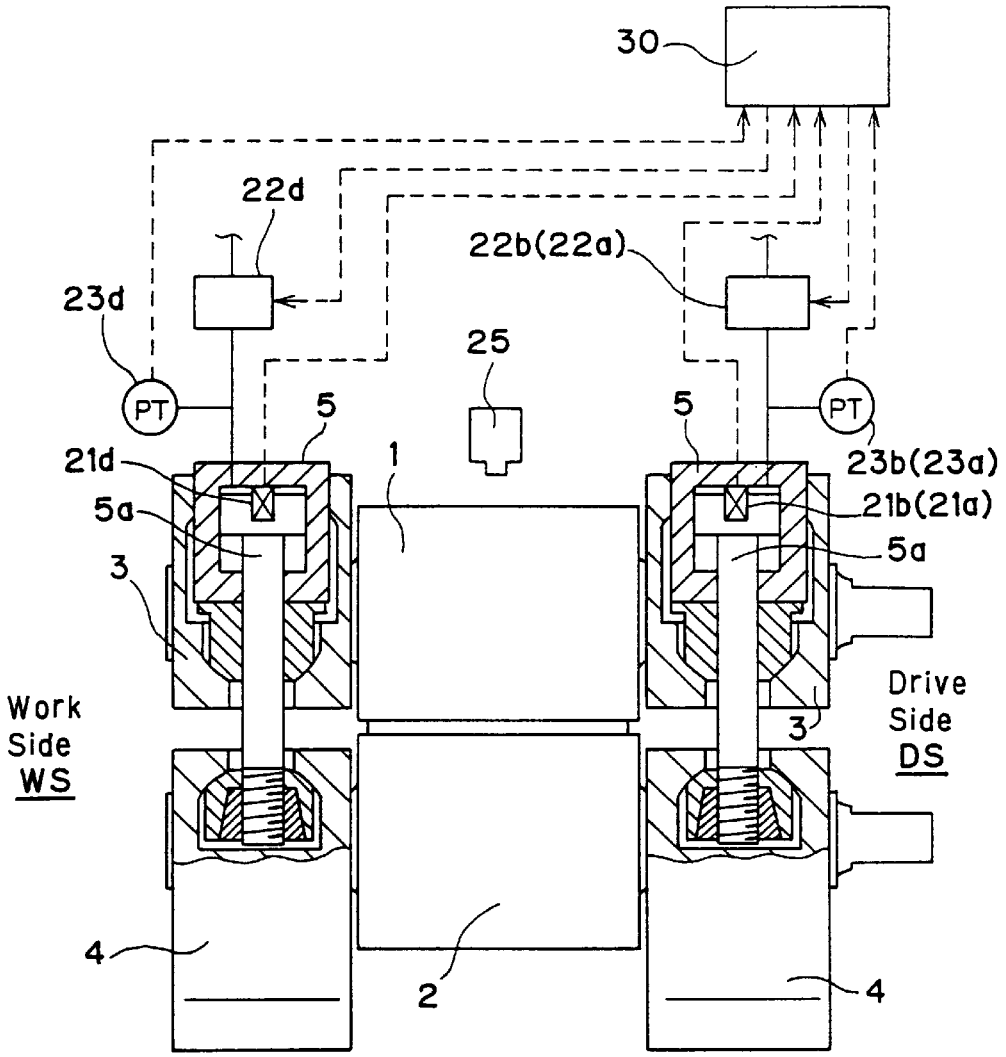
FIG. 6 is a front view of FIG. 5.

FIG. 5 is a side view of a housingless work roll cross rolling mill as a fourth embodiment of the present invention, with a roll cross mechanism and a thrust point mechanism being omitted, and various control instruments being mounted. FIG. 6 is a front view of FIG. 5. FIG. 7 is a block diagram of the various control instruments of the rolling mill shown in FIGS. 5 and 6.

In FIGS. 5 and 6, an entry/drive side cylinder position detector 21*a*, a delivery/drive side cylinder position detector 21*b*, an entry/work side cylinder position detector 21*c*, and a delivery/work side cylinder position detector 21*d* are mounted inside respective screw-down cylinders 5. These detectors are connected to a digital controller 30 as a roll gap control device.

The reference numeral 22*a* designates an entry/drive side servo valve, 22*b* a delivery/drive side servo valve, 22*c* an entry/work side servo valve, and 22*d* a delivery/work side servo valve. The serve valves are mounted to their respective screw-down cylinders 5, and are connected to the digital controller 30 and hydraulic equipment (not shown).

Between these servo valves 22*a*, 22*b*, 22*c*, 22*d* and their respective screw-down cylinders 5, an entry/drive side pressure detector 23*a*, delivery/drive side pressure detector 23*b*, an entry/work side pressure detector 23*c*, and a delivery/work side pressure detector 23*d* are placed, and connected to the digital controller 30.

The reference numeral 25 designates a zigzag movement detector, which is placed above the entry side En of the strip material 50.

The digital controller 30, as shown in FIG. 7, is composed of a rolling load computing unit 31 for receiving detection signals from the respective pressure detectors 23*a*, 23*b*, 23*c*, 23*d*; a drive side cylinder position converting unit 32*a* and a work side cylinder position converting unit 32*c* for converting gap set values into cylinder position set values; an entry/drive side zigzag movement correcting unit 33*a* and a delivery/drive side zigzag movement correcting unit 33*b* for receiving signals from the drive side cylinder position converting unit 32*a* and the rolling load computing unit 31; an entry/work side zigzag movement correcting unit 33*c* and a delivery/work side zigzag movement correcting unit 33*d* for receiving signals from the work side cylinder position converting unit 32*c* and the rolling load computing unit 31; an entry/drive side cylinder position comparison operation unit 34*a* for receiving signals from the entry/drive side cylinder position detector 21*a* and the entry/drive side zigzag movement correcting unit 33*a*; a delivery/drive side cylinder position comparison operation unit 34*b* for receiving signals from the delivery/drive side cylinder position detector 21*b* and the delivery/drive side zigzag movement correcting unit 33*b*; an entry/work side cylinder position comparison operation unit 34*c* for receiving signals from the entry/work side cylinder position detector 21*c* and the entry/work side zigzag movement correcting unit 33*c*; a delivery/work side cylinder position comparison operation unit 34*d* for receiving signals from the delivery/work side cylinder position detector 21*d* and the delivery/work side zigzag movement correcting unit 33*d*; a drive side coordination control unit 35*a* for receiving signals from the entry/drive side cylinder position comparison operation unit 34*a* and the delivery/drive side cylinder position comparison operation unit 34*b*; a work side coordination control unit 35*c* for receiving signals from the entry/work side cylinder position comparison operation unit 34*c* and the delivery/work side cylinder position comparison operation unit 34*d*; an entry/drive side servo valve actuation instructing unit 36*a* and a delivery/drive side servo valve actuation instructing unit 36*b* for receiving signals from the drive side coordination control unit 35*a* to actuate the entry/drive side servo valve 22*a* and the delivery/drive side servo valve 22*b*; and an entry/work side servo valve actuation instructing unit 36*c* and a delivery/work side servo valve actuation instructing unit 36*d* for receiving signals from the work side coordination control unit 35*c* to actuate the entry/work side servo valve 22*c* and the delivery/work side servo valve 22*d*.

Roll gap set values are entered into the drive side cylinder position converting unit 32*a* and the work side cylinder position converting unit 32*c* beforehand, and converted thereby into cylinder position set values of the respective screw-down cylinders 5 on the entry side En and the delivery side De of the drive side DS and the work side WS.

While the cylinder positions of the respective screw-down cylinders 5 are being detected by the entry/drive side cylinder position detector 21*a*, the delivery/drive side cylinder position detector 21*b*, the entry/work side cylinder position detector 21*c*, and the delivery/work side cylinder position detector 21*d*, these data are converted into analog signals by the entry/drive side servo valve actuation instructing unit 36*a*, the delivery/drive side servo valve actuation instructing unit 36*b*, the entry/work side servo valve actuation instructing unit 36*c*, and the delivery/work side servo valve actuation instructing unit 36*d*. Based on the analog signals, the respective servo valves 22*a*, 22*b*, 22*c*, 22*d* are actuated to adjust the cylinder positions of the respective screw-down cylinders 5. By this measure, the roll gap between the upper work roll 1 and the lower work roll 2 on each of the drive side DS and the work side WS is set, and the upper work roll 1 and the lower work roll 2 are rotationally driven. The transported strip material 50 is engaged into this roll gaps, and thereby rolled to a required thickness.

During the rolling of the strip material 50, the cylinder positions of the respective screw-down cylinders 5 are detected by the respective cylinder position detectors 21*a*, 21*b*, 21*c*, 21*d*. Also, the hydraulic pressures of the respective cylinders 5 are detected by the entry/drive side pressure detector 23*a*, the delivery/drive side pressure detector 23*b*, the entry/work side pressure detector 23*c*, and the delivery/work side pressure detector 23*d*. These data are transmitted to the rolling load computing unit 31 to calculate the rolling load amounts. The entry/drive side zigzag movement correcting unit 33*a*, the delivery/drive side zigzag movement correcting unit 33*b*, the entry/work side zigzag movement correcting unit 33*c*, and the delivery/work side zigzag movement correcting unit 33*d* calculate zigzag movement correction amounts to be described later on, and add them to the respective cylinder position set values that have been set previously.

The respective cylinder position set values are subjected to comparison operation by the entry/drive side cylinder position comparison operation unit 34*a*, the delivery/drive side cylinder position comparison operation unit 34*b*, the entry/work side cylinder position comparison operation unit 34*c*, and the delivery/work side cylinder position comparison operation unit 34*d* in comparison with the respective cylinder positions detected by the respective cylinder position detectors 21*a*, 21*b*, 21*c*, 21*d* on the drive side DS and the work side WS. Based on the results, these data are converted into analog signals by the respective servo valve actuation instructing units 36*a*, 36*b*, 36*c*, 36*d* while the cylinder positions on the entry side En and the delivery side De of the drive side DS and those on the entry side En and the delivery side De of the work side WS are being coordinated by the drive side coordination control unit 35*a* and the work side coordination control unit 35*c*. Based on the analog signals, the respective servo valves 22*a*, 22*b*, 22*c*, 22*d* are actuated to control the thickness of the strip material 50.

When a plurality of the rolling mills are placed in series, a drive side-work side load difference is measured a certain period of time before departure of the rear end of the strip material 50 from the preceding stand. This load difference is used as a reference value, and a zigzag movement correction amount is calculated from a deviation from the reference value. Based on the results of calculation, the drive side-work side leveling amounts of the screw-down cylinders are adjusted to control a zigzag movement of the strip material 50 after departure of its rear end from the preceding stand.

Figure 8:
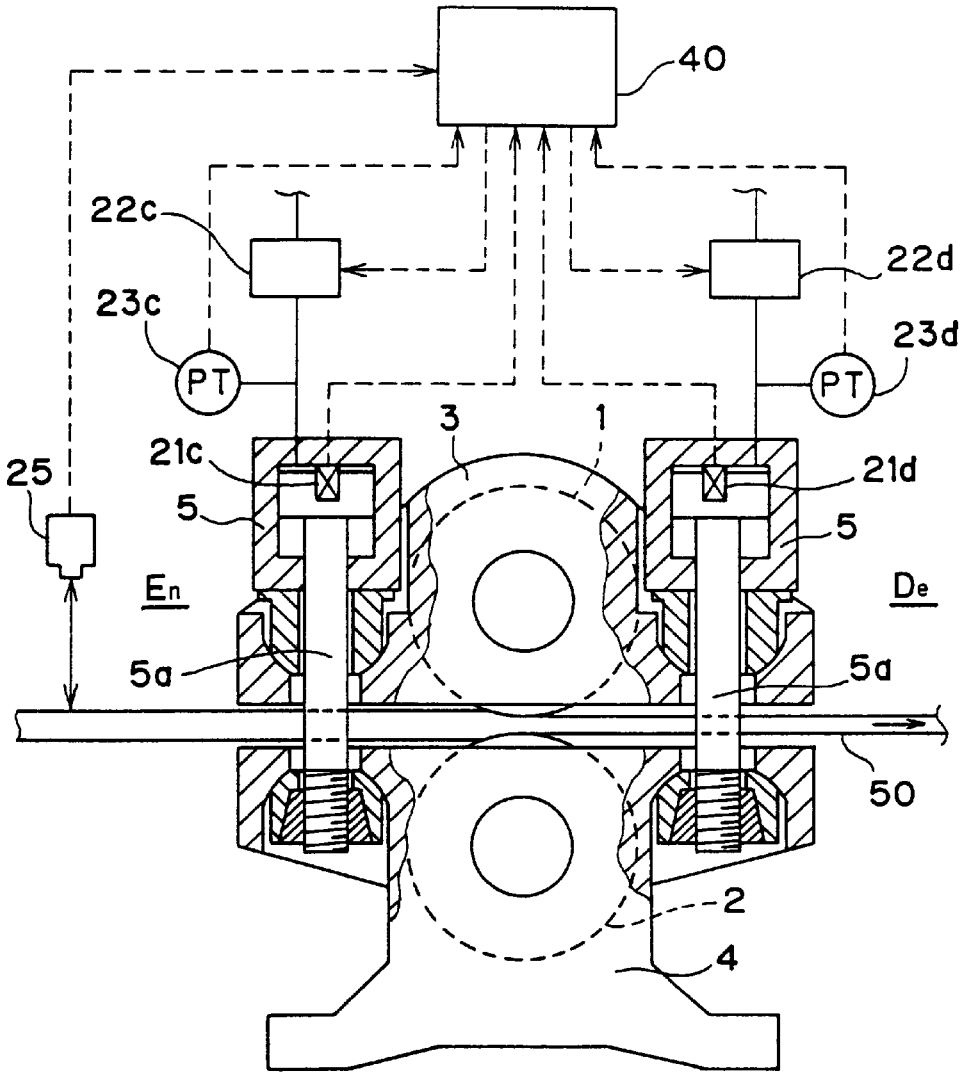
FIG. 8 is a side view of a housingless work roll cross rolling mill as a fifth embodiment of the present invention, with a roll cross mechanism and a thrust point mechanism being omitted, and various control instruments being mounted.
Figure 9:
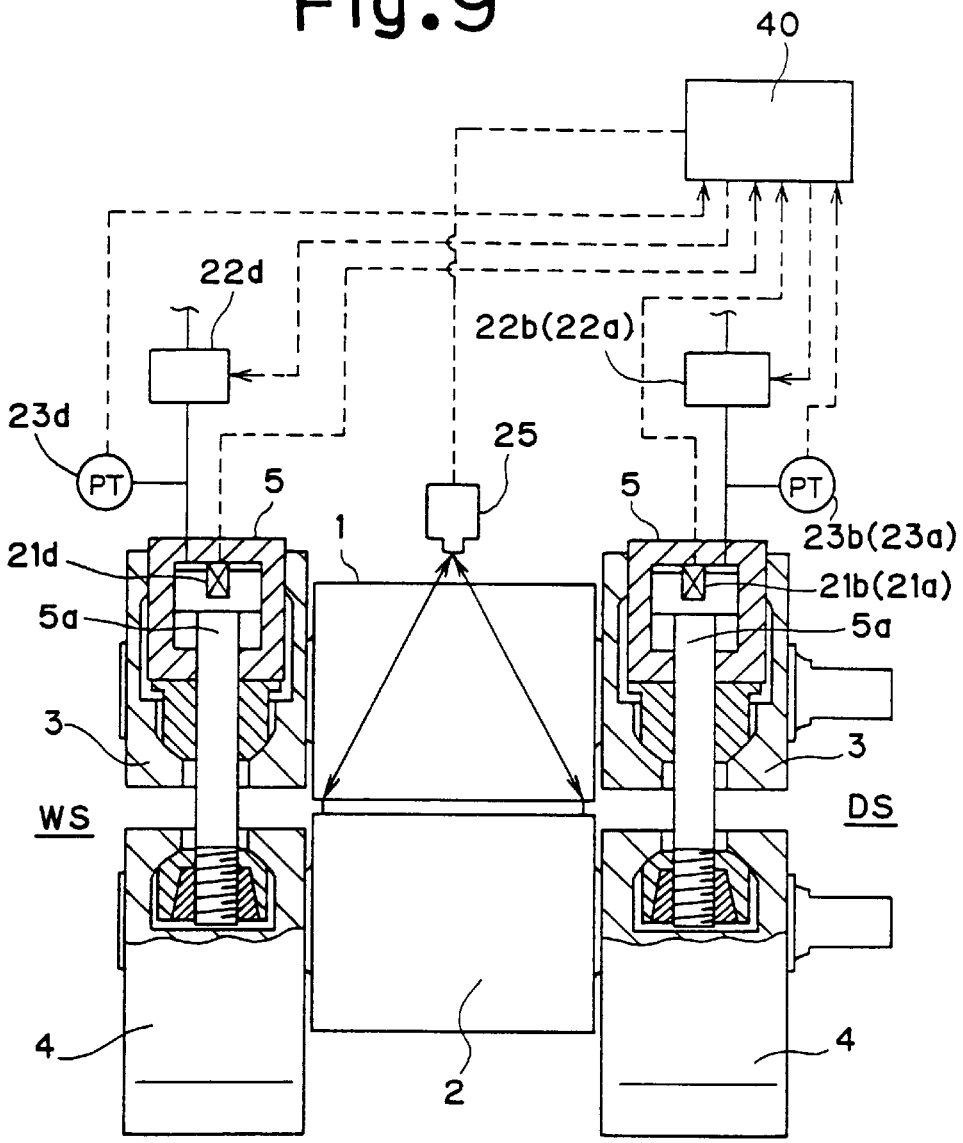
FIG. 9 is a front view of FIG. 8.
Figure 11:
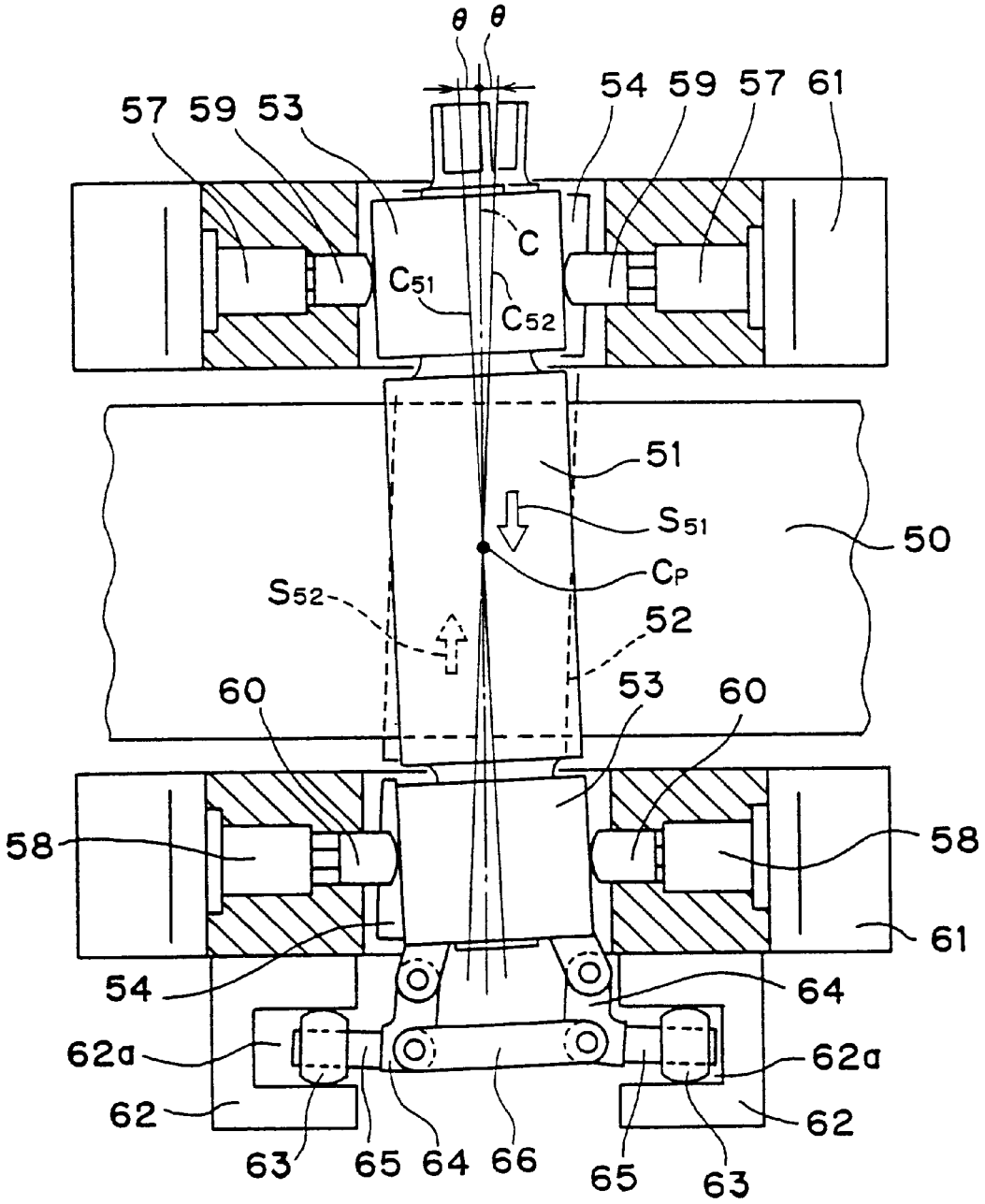
Fig.11 (PRIOR ART)
FIG. 11 is a plan view of a work roll cross rolling mill as an example of a conventional two-high rolling mill, with housings being broken away in a horizontal direction.
Figure 12:
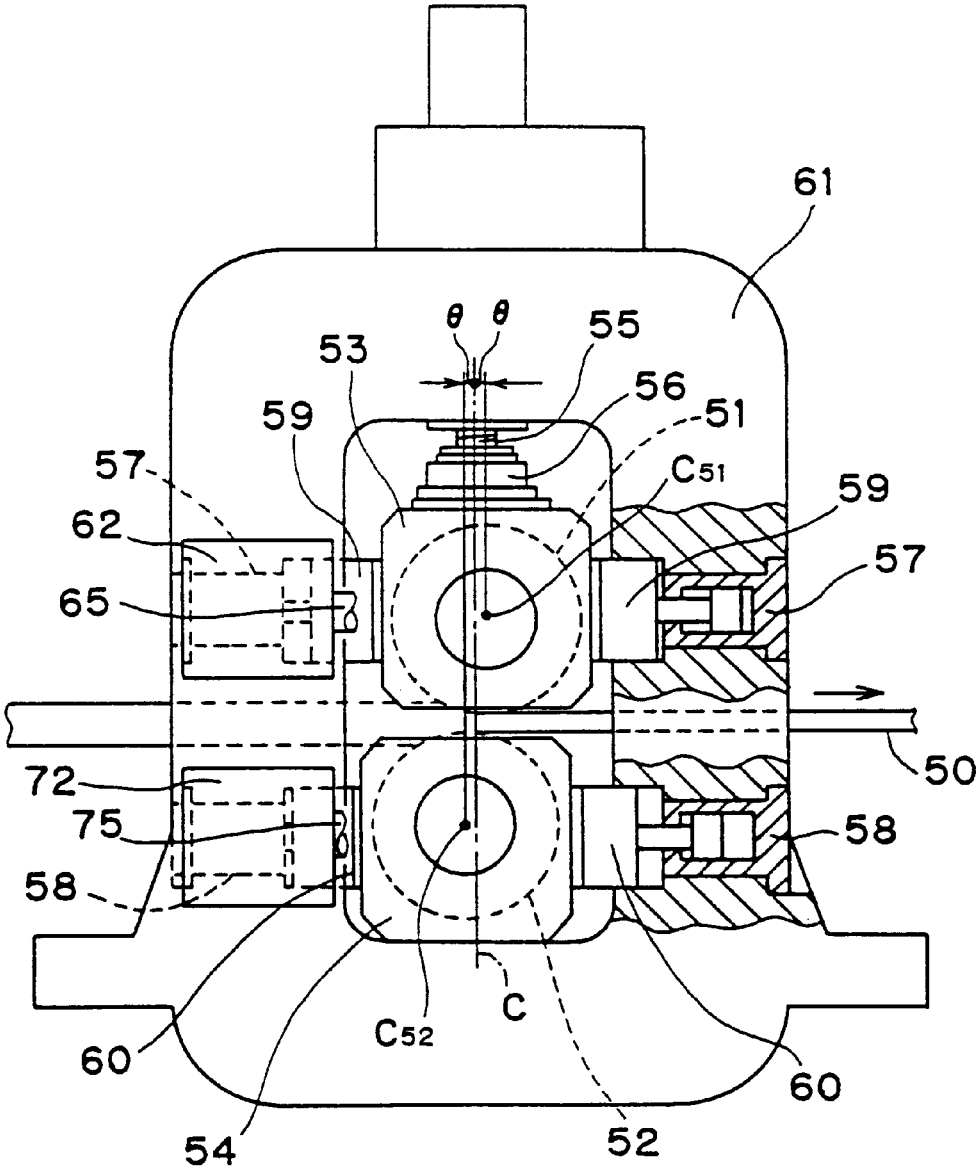
Fig.12 (PRIOR ART)
FIG. 12 is a side view, partly broken away, of the rolling mill of FIG. 11.

FIG. 8 is a side view of a housingless work roll cross rolling mill as a fifth embodiment of the present invention, with a roll cross mechanism and a thrust point mechanism being omitted, and various control instruments being mounted. FIG. 9 is a front view of FIG. 8. FIG. 10 is a block diagram of the various control instruments of the rolling mill shown in FIGS. 8 and 9.

In FIGS. 8 and 9, a zigzag movement detector 25 is placed above an entry side En of a strip material 50, and connected to a digital controller 40 as a roll gap control device. Respective cylinder position detectors 21*a* to 21*d* are also connected to screw-down cylinders 5 and the digital controller 40 in the same manner as in the fourth embodiment.

The digital controller 40, as shown in FIG. 10, is composed of a zigzag movement computing unit 41 for receiving signals from a zigzag movement detector 25 and transmitting signals to an entry/drive side zigzag movement correcting unit 33*a*, a delivery/drive side zigzag movement correcting unit 33*b*, an entry/work side zigzag movement correcting unit 33*c*, and a delivery/work side zigzag movement correcting unit 33*d*; and the same members as in the fourth embodiment, i.e., a drive side cylinder position converting unit 32*a*, a work side cylinder position converting unit 32*c*, an entry/drive side zigzag movement correcting unit 33*a*, a delivery/drive side zigzag movement correcting unit 33*b*, an entry/work side zigzag movement correcting unit 33*c*, a delivery/work side zigzag movement correcting unit 33*d*, an entry/drive side cylinder position comparison operation unit 34*a*, a delivery/drive side cylinder position comparison operation unit 34*b*, an entry/work side cylinder position comparison operation unit 34*c*, a delivery/work side cylinder position comparison operation unit 34*d*, a drive side coordination control unit 35*a*, a work side coordination control unit 35*c*, an entry/drive side servo valve actuation instructing unit 36*a*, a delivery/drive side servo valve actuation instructing unit 36*b*, an entry/work side servo valve actuation instructing unit 36*c*, and a delivery/work side servo valve actuation instructing unit 36*d*.

In the same manner as in the fourth embodiment, roll gap set values are entered into the drive side cylinder position converting unit 32*a* and the work side cylinder position converting unit 32*c* beforehand, and converted thereby into cylinder position set values of the respective screw-down cylinders 5.

While the cylinder positions of the respective screw-down cylinders 5 are being detected by the respective cylinder position detectors 21*a*, 21*b*, 21*c*, and 21*d*, the relevant data are converted into analog signals by the respective servo valve actuation instructing units 36*a*, 36*b*, 36*c*, and 36*d*. Based on the analog signals, the respective servo valves 22*a*, 22*b*, 22*c*, 22*d* are actuated to adjust the cylinder positions of the respective screw-down cylinders 5. By this measure, the roll gap between the upper work roll 1 and the lower work roll 2 on each of the drive side DS and the work side WS is set, and the upper work roll 1 and the lower work roll 2 are rotationally driven. The transported strip material 50 is engaged into this roll gaps, and thereby rolled to a required thickness.

During the rolling of the strip material 50, the cylinder positions of the respective screw-down cylinders 5 are detected by the respective cylinder position detectors 21*a*, 21*b*, 21*c*, 21*d*. Also, a zigzag movement on the entry side En of the strip material 50 is detected by the zigzag movement detector 25. Its signals are transmitted to the zigzag movement computing unit 41 to calculate zigzag movement amounts. The zigzag movement correcting units 33*a*, 33*b*, 33*c*, 33*d* calculate zigzag movement correction amounts to be described later on, and add them to the respective cylinder position set values that have been set previously.

The respective cylinder position set values are subjected to comparison operation by the respective cylinder position comparison operation units 34*a*, 34*b*, 34*c*, 34*d* in comparison with the respective cylinder positions detected by the respective cylinder position detectors 21*a*, 21*b*, 21*c*, 21*d* on the drive side DS and the work side WS. Based on the results, the respective servo valves 22*a*, 22*b*, 22*c*, 22*d* are actuated, as described in the fourth embodiment, to control the thickness and a zigzag movement of the strip material 50.

The zigzag movement correction amount is calculated from the zigzag movement amount detected by the zigzag movement detector 25. Based on the results of calculation, the drive side-work side leveling amounts of the screw-down cylinders 5 are adjusted to control a zigzag movement of the strip material 50 during its rolling and after departure of its rear end from the preceding stand.

Needless to say, the present invention is not limited to the foregoing embodiments, and various changes and modifications, such as those in the structures and shapes of various parts in the housingless rolling mill, may be made without departing from the gist of the invention. The housingless rolling mill according to the invention can be applied to a roughing mill of hot rolling equipment, and can be used as a rolling mill of other rolling equipment.

(1) According to the first aspect of the invention, the roll screw-down devices are provided for pulling the upper bearing blocks and the lower bearing blocks, which support the upper work roll and the lower work roll, to each other vertically on the entry side and the delivery side. Thus, heavy housings are not needed, and the structure of the rolling mill can be simplified. Hence, the rolling mill can be downsized, its manufacturing cost and maintenance cost can be reduced, and its installation space can be decreased. When a plurality of the rolling mills are arranged tandem in a row, their line can be shortened. When the rolling mills are arranged in a row on a hot rolling line, spacing between the rolling mills is decreased. Thus, cooling and oxidation-associated scale of the material to be rolled can be prevented.

(2) According to the second aspect of the invention, the roll screw-down devices are tiltable, legs of the lower bearing block are supported so as to be turnable in the roll cross direction, lower cross cylinders are provided at the lower bearing block, and upper cross cylinders are provided at the upper bearing block. Thus, in addition to the effects of (1), the upper work roll and the lower work roll can be made to cross each other during rolling of the material to be rolled. Thus, the thickness distribution of the material to be rolled can be kept satisfactory in its width direction.

(3) According to the third aspect of the invention, the supported member is provided in at least one of the upper bearing blocks and the lower bearing blocks in the thrust direction, the thrust point member which engages the supported member is provided in at least the other of the upper bearing blocks and the lower bearing blocks in the direction opposite to the thrust direction. Thus, in addition to the effects of (2), the upper thrust force and the lower thrust force can be counteracted, so that the thrust point device can be simplified. Besides, the thrust force support surface of the thrust point member is in the form of an arcuate curved surface with a radius about the work roll cross point as a center. As a result, the upper work roll and the lower work roll are made to cross smoothly, and the upper thrust force and the lower thrust force can be supported relative to each other.

(4) According to the fourth aspect of the invention, the rolling mill further comprises the screw-down amount detectors provided in the respective screw-down cylinders at the entry side and the delivery side of the upper bearing blocks and lower bearing blocks on the drive side and the work side, the pressure detectors for detecting the load pressures of the respective screw-down cylinders, and the roll gap control device for receiving detected values from the respective screw-down amount detectors and pressure detectors and actuating the respective roll screw-down devices. Thus, in addition to the effects of (1), the thickness and a zigzag movement of the material to be rolled can be controlled easily. Hence, the thickness accuracy of the material to be rolled can be improved, and its zigzag movement can be suppressed. This decreases the risk of an accident, such as a flaw, crack or rupture of the work roll, due to a folded rear end of the material passed between the work rolls.

(5) According to the fifth aspect of the invention, the rolling mill further comprises the screw-down amount detectors provided in the respective screw-down cylinders, the zigzag movement detector provided on the entry side of the upper and lower work rolls, and the roll gap control device for receiving detected values from the respective screw-down amount detectors and the zigzag movement detector and actuating the respective roll screw-down devices. Thus, in addition to the effects of (1), the thickness of the material to be rolled can be controlled easily and accurately, and its zigzag movement can be controlled accurately. Hence, the thickness accuracy of the material to be rolled can be improved, and its zigzag movement can be further suppressed to decrease the risk of the above-mentioned accident.

What is claimed is:

1. A housingless rolling mill, comprising:

an upper work roll;

a lower work roll;

upper bearing blocks and lower bearing blocks for supporting end portions of the upper and lower work rolls; and a plurality of tiltable roll screw-down devices for pulling the upper and lower bearing blocks vertically toward each other on an entry side and a delivery side of said respective upper and lower bearing blocks, wherein said roll screw-down devices being tiltable so as to control a roll gap between said rolls and a thickness of a strip material therebetween.

2. The housingless rolling mill of claim 1, wherein protrusions are formed at an entry side and a delivery side of each of the upper and lower bearing blocks, an upper spherical hole and a lower spherical hole are bored in the protrusions of the upper and lower bearing blocks to define spherical portions which are vertically opposed to each other, an upper spherical bush and a lower spherical bush sliding over the upper and lower spherical portions provided at an upper site and a lower site of the roll screw-down device, thereby making the roll screw-down device tiltable, legs of the lower bearing block are turnable in a roll cross direction, lower roll cross devices are provided at the lower bearing block, and upper roll cross devices are provided at the upper bearing block.

3. The housingless rolling mill of claim 2, wherein a supported member is provided in at least one of the upper and lower bearing blocks, said supported member oriented in a thrust direction of at least one of the upper and lower work rolls, a thrust point member engaging the supported member provided in at least the other of the upper and lower bearing blocks, said thrust point member oriented in the direction opposite to the thrust direction, and a surface of the thrust point member supporting the supported member has an arcuate curved surface of a radius originating from a work roll cross point at a center of the rolling mill.

4. The housingless rolling mill of claim 1, further including:

an entry/drive side screw-down amount detector, a delivery/drive side screw-down amount detector, an entry/work side screw-down amount detector and a delivery/work side screw-down amount detector provided in screw-down cylinders of the roll screw-down devices at entry and delivery sides respectively of the upper and lower bearing blocks;

an entry/drive side pressure detector, a delivery/drive side pressure detector, an entry/work side pressure detector, and a delivery/work side pressure detector for detecting load pressures of the respective screw-down cylinders; and a roll gap control device for receiving detection signals from the respective screw-down amount detectors and pressure detectors, and for actuating the roll screw-down devices on the drive and work sides of the upper and lower work rolls.

5. The housingless rolling mill of claim 1, further including:

an entry/drive side screw-down amount detector, a delivery/drive side screw-down amount detector, an entry/work side screw-down amount detector, and a delivery/work side screw-down amount detector provided in screw-down cylinders of the roll screw-down devices at entry and delivery sides respectively of the upper and lower bearing blocks;

a zigzag movement detector provided on the entry side of the upper and lower work rolls; and a roll gap control device for receiving detection signals from the respective screw-down amount detectors and the zigzag movement detector, and for actuating the roll screw-down devices on the drive and work sides of the upper and lower work rolls.

6. The housingless roll mill as defined in claim 1, wherein said roll gap and strip material thickness are based on a comparison of detected signals with pre-set roll gap values.

7. A housingless rolling mill, comprising:

an upper work roll;

a lower work roll;

upper and lower bearing blocks for supporting end portions of said upper and lower work rolls;

upper and lower spherical bushes sliding over upper and lower spherical portions on said respective upper and lower bearing blocks; and roll screw-down devices for pulling the upper and lower bearing blocks vertically toward each other on an entry side and a delivery side of the respective upper and lower bearing blocks, wherein said upper and lower spherical bushes are located on said roll screw-down devices, thereby making said roll screw-down devices tiltable.

8. The housingless rolling mill as defined in claim 7, further including:

protrusions formed at said entry and delivery sides of each of said upper and lower bearing blocks; and upper and lower spherical holes bored in said protrusions, said holes defining said upper and lower spherical portions, said spherical portions vertically opposed to each other.

9. The housingless rolling mill as defined in claim 8, further including:

lower bearing block legs attached to said lower bearing block, said legs turnable in a roll cross direction;

lower roll cross devices provided at said lower bearing block; and upper roll cross devices provided at said upper bearing block, said upper and lower roll cross devices adjusted to control thickness distribution of a strip material in a widthwise direction.

10. The housingless rolling mill as defined in claim 7, further including:

position detectors provided in screw-down cylinders of said roll screw-down devices for detecting cylinder position;

pressure detectors provided at said roll screw-down devices for detecting cylinder load pressure; and a roll gap control device for receiving signals from said position and pressure detectors to control said roll screw-down devices on both a drive side and a work side of said upper and lower work rolls.

11. The housingless rolling mill as defined in claim 10, further including a zigzag movement detector provided on an entry side of said upper and lower work rolls for detecting zigzag movement of a strip material fed to said rolls.

12. The housingless rolling mill as defined in claim 7, further including:

a support member provided in at least one of the upper and lower bearing blocks, said support member oriented in a thrust direction in at least one of said upper and lower work rolls;

a thrust point member provided in the other of said upper and lower bearing blocks, said thrust point member supporting said support member and oriented in a direction opposite to said thrust direction, and further including an arcuate curved surface having a radius originating from a work roll cross point at a center of the rolling mill.

13. A housingless rolling mill, comprising:

an upper work roll;

a lower work roll;

upper and lower bearing blocks for supporting end portions of said upper and lower work rolls;

lower bearing block legs attached to said lower bearing block, said legs turnable in a roll cross direction;

roll screw-down devices for pulling the upper and lower bearing blocks vertically toward each other on an entry side and a delivery side of the respective upper and lower bearing blocks;

upper roll cross devices provided at said upper bearing block; and lower roll cross devices provided at said lower bearing block, wherein said upper and lower roll cross devices are adjustable to control thickness distribution of a strip material in a widthwise direction.

14. The housingless rolling mill as defined in claim 13, further including:

protrusions formed at entry and delivery sides of each of said upper and lower bearing blocks; and upper and lower spherical holes bored in said protrusions, said holes defining upper and lower spherical portions, wherein said spherical portions are vertically opposed to each other.

15. The housingless rolling mill as defined in claim 14, further including upper and lower spherical bushes sliding over said upper and lower spherical portions, said upper and lower spherical bushes located on said roll screw-down devices, thereby making said roll screw-down devices tiltable.

16. The housingless rolling mill as defined in claim 13, further including:

position detectors provided in screw-down cylinders of said roll screw-down devices for detecting cylinder position;

pressure detectors provided at said roll screw-down devices for detecting cylinder load pressure; and a roll gap control device for receiving signals from said position and pressure detectors to control said roll screw-down devices on both a drive side and a work side of said upper and lower work rolls.

17. The housingless rolling mill as defined in claim 16, further including a zigzag movement detector provided on an entry side of said upper and lower work rolls for detecting zigzag movement of a strip material fed to said rolls.

18. The housingless rolling mill as defined in claim 13, further including:

a support member provided in at least one of the upper and lower bearing blocks, said support member oriented in a thrust direction in at least one of said upper and lower work rolls; and a thrust point member provided in the other of said upper and lower bearing blocks, said thrust point member supporting said support member and oriented in a direction opposite to said thrust direction, and further including an arcuate curved surface having a radius originating from a work roll cross point at a center of the rolling mill.

19. The housingless rolling mill as defined in claim 7, wherein said roll screw-down devices are tiltable so as to control roll gap between said rolls and thickness of a strip material therebetween, said roll gap and strip material thickness based on a comparison of detected signals with pre-set roll gap values.

20. The housingless rolling mill as defined in claim 13, wherein said roll screw-down devices are tiltable so as to control roll gap between said rolls and thickness of a strip material therebetween, said roll gap and strip material thickness based on a comparison of detected signals with pre-set roll gap values.

* * * * *